US008291736B2

(12) United States Patent
Schmidt

(10) Patent No.: US 8,291,736 B2
(45) Date of Patent: Oct. 23, 2012

(54) METHOD FOR THE OPERATION OF A ROLLING MILL USED FOR MILLING A STRIP-SHAPED ROLLING STOCK

(75) Inventor: Birger Schmidt, Brand-Erbisdorg (DE)

(73) Assignee: Siemens Aktiengesellschaft, München (DE)

( * ) Notice: Subject to any disclaimer, the term of this patent is extended or adjusted under 35 U.S.C. 154(b) by 904 days.

(21) Appl. No.: 12/225,090

(22) PCT Filed: Feb. 1, 2007

(86) PCT No.: PCT/EP2007/050985

§ 371 (c)(1),
(2), (4) Date: Mar. 3, 2009

(87) PCT Pub. No.: WO2007/104604

PCT Pub. Date: Sep. 20, 2007

(65) Prior Publication Data

US 2009/0235707 A1 Sep. 24, 2009

(30) Foreign Application Priority Data

Mar. 15, 2006 (DE) ..... 10 2006 011 975

(51) Int. Cl.
*B21B 37/58* (2006.01)
*B21B 39/20* (2006.01)
*B21B 37/72* (2006.01)

(52) U.S. Cl. ..... 72/10.3; 72/251; 72/7.5

(58) Field of Classification Search ..... 72/234, 72/365.2, 366.2, 8.8, 11.5, 12.5, 10.3, 425, 72/443, 227, 250, 251, 11.1, 8.1, 240, 8.3, 72/7.5; 700/149, 150, 151
See application file for complete search history.

(56) References Cited

U.S. PATENT DOCUMENTS

| | | | | |
|---|---|---|---|---|
| 2,654,278 | A * | 10/1953 | Mathias | 72/12.5 |
| 4,590,778 | A | 5/1986 | Klöckner et al. | |
| 2008/0060403 | A1 * | 3/2008 | Felkl et al. | 72/12.3 |

FOREIGN PATENT DOCUMENTS

| | | | |
|---|---|---|---|
| DE | 3116278 | A1 | 11/1982 |
| EP | 0166981 | A1 | 1/1986 |
| EP | 0925854 | A2 | 6/1999 |
| GB | 2100475 | A | 12/1982 |
| JP | 9001219 | A | 1/1997 |
| RU | 2197349 | C2 | 1/2003 |
| SU | 789352 | A1 | 12/1980 |
| SU | 1378969 | A1 | 3/1988 |

* cited by examiner

*Primary Examiner* — Dana Ross
*Assistant Examiner* — Mohammad I Yusuf

(57) ABSTRACT

Disclosed is a rolling mill comprising a roll stand with working rolls, a roll train located at the feeding end of the roll stand, and a control device. The working rolls form a roll gap. The control device triggers the roll stand such that the working rolls rotate at a certain peripheral speed while triggering the roll train located at the feeding end of the roll stand in such a way that the leading edge of the strip-shaped rolling stock reaches the roll gap at a feeding speed that is greater than the peripheral speed. The control device adjusts the peripheral speed and the feeding speed to each other in such a way that a potential angled position of the leading edge relative to the roll gap is at least reduced as a result of said adjustment.

20 Claims, 5 Drawing Sheets

METHOD FOR THE OPERATION OF A ROLLING MILL USED FOR MILLING A STRIP-SHAPED ROLLING STOCK

CROSS REFERENCE TO RELATED APPLICATIONS

This application is the US National Stage of International Application No. PCT/EP2007/050985, filed Feb. 1, 2007 and claims the benefit thereof. The International Application claims the benefits of German application No. 10 2006 011 975.4 filed Mar. 15, 2006, both of the applications are incorporated by reference herein in their entirety.

FIELD OF INVENTION

The present invention relates to a method for the operation of a rolling mill used for milling a strip-shaped rolling stock that is provided with a leading edge with two ends. The rolling mill comprises a roll stand with working rolls, a roll train located at the feeding end of the roll stand and a control device. The working rolls form a roll gap. The control device triggers the roll stand such that the working rolls of the roll stand rotate with a certain peripheral speed. The control device further triggers the roll train located at the feeding end of the roll stand so that the leading edge of the strip-shaped rolling stock reaches the roll gap at a feeding speed.

The present invention further relates to a data medium with a computer program stored on said data medium for executing such as method of operation, if the computer program is executed by a control device for a rolling mill. The present invention also relates to a control device for a rolling mill which is embodied, especially programmed, so that the rolling mill is able to be controlled by it in accordance with such a method of operation.

The present invention also relates to a rolling mill for rolling a strip-shaped rolling stock, comprising a roll stand with working rolls, a roll train located on the feeding side of the roll stand and a control device, with the working rolls forming a roll gap and the roll stand and the roll train arranged on the input side of the roll stand being able to be controlled by the control device such that the working rolls of the roll stand turn at a peripheral speed and a leading edge of the strip-shaped rolling stock reaches the roll gap at a feeding speed.

Finally the present invention also relates a strip-shaped rolling stock, having a leading edge with two ends and which was milled in accordance with a method of operation described above.

BACKGROUND OF THE INVENTION

During milling of strip-shaped rolling stock the rolling stock is generally fed into the roll stand at a feeding speed which is less than the peripheral speed of the working rolls of the roll stand. As the leading edge of the rolling stock enters the roll gap the roll gap is closed and the rolling stock is milled.

The above method represents the theoretical ideal case, in which the leading edge is aligned in parallel to the roll gap and thus also enters the roll-gap in this alignment. In practice however it can occur that the two ends of the leading edge enter the roll gap after each other, the leading edge thus has an angled position relative to the roll gap. In this case what is referred to as a diagonal delay occurs, which on the one hand leads to an excess width of the rolling stock, on the other hand the rolling stock assumes the shape of a parallelogram. Both effects reduce what is known as yield, meaning the proportion of usable rolling stock volume.

To avoid the angled position, the prior art employed so called material guides. The material guides are adjusted laterally to the strip-shaped rolling stock. They align the strip-shaped rolling stock such that the leading edge is aligned in parallel to the roll gap.

The alignment of the rolling stock is time-consuming and has a negative influence on the productivity of the rolling mill. In addition only a poor alignment is possible, especially when the strip-shaped rolling stock has a large width-to-length ratio. In addition there is the danger, even with correct alignment of the rolling stock, that the rolling stock will twist again between alignment by the material guides and being fed into the roll gap, so that, despite the material guides, an angled position of the leading edge relative to the roll gap occurs. The danger of twisting of the rolling stock is in such case all the greater, the greater than 1 the ratio of width to length of the strip-shaped rolling stock is and the smaller the ratio of length of the strip-shaped rolling stock to distance of the transport rollers of the roll train located on the feeding side of the roll stand.

SUMMARY OF INVENTION

The object of the present invention is to improve a method for operation of a rolling mill for milling strip-shaped rolling stock such that the productivity and the yield are increased.

The object is achieved using a method of operation of the type stated at the outset by the feeding speed being greater than the peripheral speed and the control device matching the peripheral speed and the feeding speed to each other such that, because the peripheral speed is synchronized with the feeding speed, an angled position of the leading edge relative to the roll gap is at least reduced.

Accordingly the object is thus achieved by a corresponding computer program being stored on the data medium or by the control device for the rolling mill being appropriately embodied, especially programmed.

For the rolling mill the object is achieved by the feeding speed being greater than the peripheral speed and the peripheral speed and the feeding speed being able to be synchronized by the control device such that, because of the synchronization of the peripheral speed and the feeding speed, any angled position of the leading edge relative to the roll gap is at least reduced.

Accordingly the object is achieved for the strip-shaped rolling stock by milling having been conducted with the above method of operation during at least one milling process.

It is possible for the control device to synchronize the peripheral speed and the feeding speed such that the strip-shaped rolling stock, in the event of one of the ends of the leading edge reaching the roll gap before the other of the ends, turns around the end reaching the roll gap first. The end of the leading edge reaching the roll gap later thus slides onto the roll gap. This method of operation is generally preferable.

In individual cases it can be useful for the control device to synchronize the peripheral speed and the feeding speed such that the strip-shaped rolling stock, in the event of one-of the ends of the leading edge reaching the roll gap before the other end of the ends of the leading edge, rebounds from the roll gap with the end reaching the roll gap first. In this case an especially precise synchronization of the peripheral speed and the feeding speed is necessary, so that the strip-shaped rolling stock does not rebound too far.

The inventive method of operation can especially also be used for existing rolling mills, i.e. with rolling mills which feature the material guides mentioned above. These material guides are generally able to be adjusted to the rolling stock. Within the framework of the present invention the control device preferably triggers the material guides so that they do not touch the strip-shaped rolling stock.

Preferably the control device accepts characteristic variables of the strip-shaped rolling stock and of the rolling mill and, on the basis of the characteristic variables, computes of the peripheral speed and the feeding speed in a model. The length, the width, the thickness and the mass of the rolling stock are especially taken into consideration as characteristic variables of the rolling stock. The spacing of individual transport rollers of the roll train, the roll gap and the diameter of the working rolls are especially considered as characteristic variables of the rolling mill.

Preferably the control device uses the characteristic variables to test whether an execution condition is fulfilled. Only if the execution condition is fulfilled does the control device synchronize the peripheral speed and the feeding speed in accordance with the method described above. If on the other hand the execution condition is not fulfilled, the control device synchronizes the peripheral speed and the feeding speed such that any angled position of the leading edge relative to the roll gap is not reduced because of the synchronization of the peripheral speed and the feeding speed. Any angled position of the leading edge relative to the roll gap may thus be reduced, but not because of the synchronization of the peripheral speed and the feeding speed. This synchronization in this case has no influence on the reduction of the angled position.

Different variables can be included in the execution condition. Preferably a length of the strip-shaped rolling stock, a width of the strip-shaped rolling stock, a ratio of length and width of the strip-shaped rolling stock and/or a mass of the strip-shaped rolling stock are included in the execution condition.

As already mentioned, the roll train located on the feeding side of the roll stand can feature material guides which are able to be adjusted laterally to the strip-shaped rolling stock. If the execution condition is not fulfilled, the control device preferably sets the material guides such that they touch the strip-shaped rolling stock. The strip-shaped rolling stock is thus aligned in this case either in accordance with the inventive method but also in accordance with the conventional method (i.e. through the material guides).

BRIEF DESCRIPTION OF THE DRAWINGS

Further advantages and details can be found in the following description of exemplary embodiments in conjunction with the drawings. The drawings show the following basic principles.

DETAILED DESCRIPTION OF INVENTION

Figure 1:
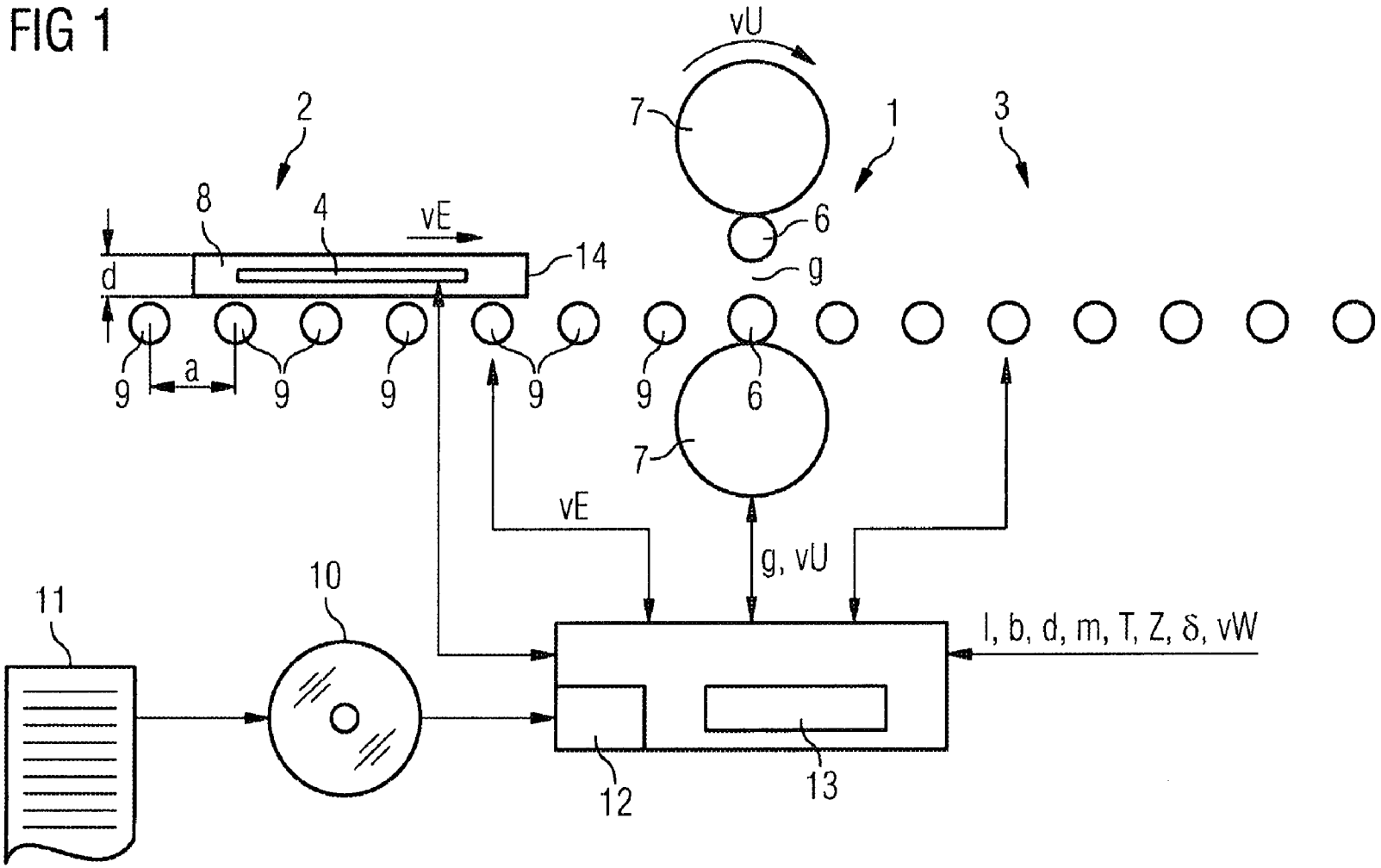
FIG. 1 a schematic side view of a rolling mill.
Figure 2:
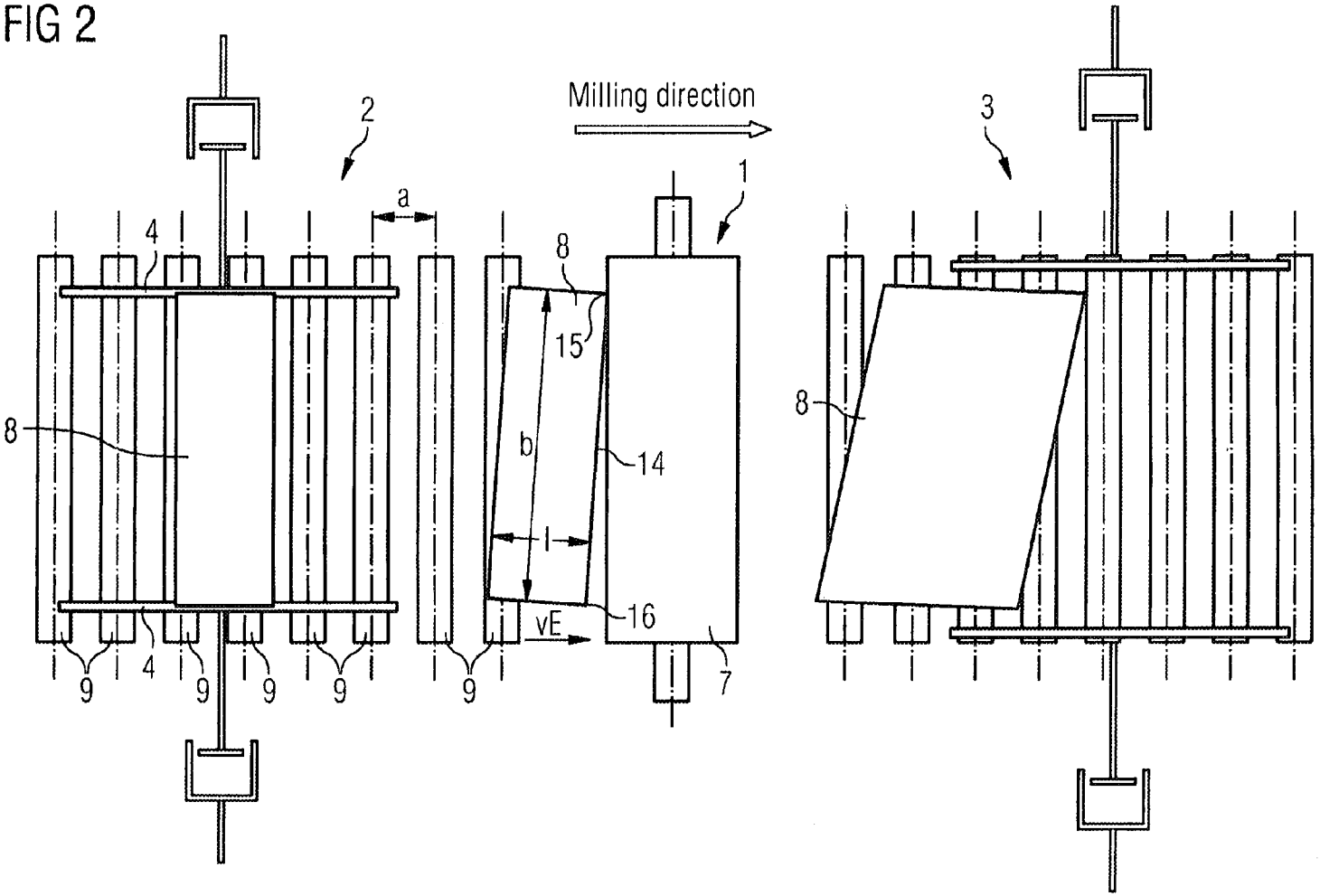
FIG. 2 the rolling mill of FIG. 1 from above.

In accordance with FIGS. 1 and 2 a rolling mill features a roll stand 1, two roll trains 2, 3, material guides 4 and a control device 5. The roll stand 1 features at least two working rolls 6, as a rule further rolls 7 as well, for example two support rolls 7.

The rolling mill is used for milling a strip-shaped rolling stock 8. One of the two roll trains 2, 3 is arranged on the feeding side and the output side of the roll stand 1 respectively. The roll trains 2, 3 each feature a number of transport rolls 9 spaced at a distance from one another. The material guides 4 are arranged on the entry-side roll train 2. They are able to be laterally adjusted to the rolling stock 8. The control device 5 is used to control and coordinate the roll stand 1, the material guides 4 and the transport rolls 9 of the roll trains 2, 3.

This computer program 11 is fed to the control device 5 via a data medium 10, on which a computer program 11 is stored. The control device 5 receives the computer program 11 and stores it in an internal memory 12. This programs (or more generally embodies) the control device 5 such that, when the computer program 11 is called, the rolling mill is operated in accordance with a method of operation which will be explained in greater detail in connection with FIG. 3.

Figure 3:
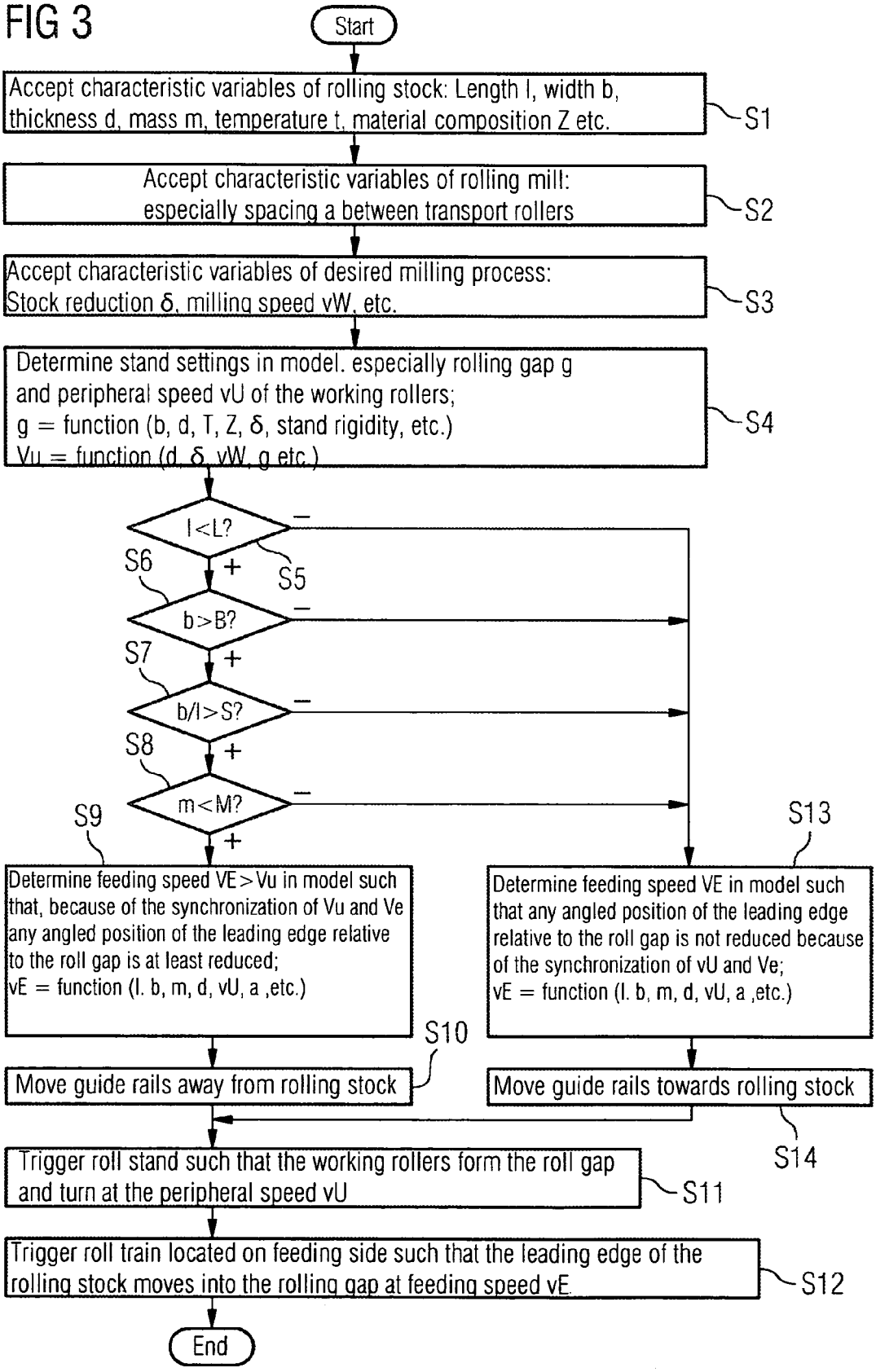
FIG. 3 a flowchart.

In accordance with FIG. 3 the control device 5, in a step S1 initially accepts characteristic variables of the rolling stock 8. The characteristic variables of the rolling stock 8 especially include its length L, its width b, its thickness d, its mass m, its temperature T and its material composition Z. If necessary further variables of the rolling stock 8 can also be supplies to the control device 5 within the framework of the step S1.

In a step S2 the control device 5 accepts further characteristic variables of the rolling mill. The characteristic variables of the rolling mill especially include the diameter of the working roils 6 and the distance a of the transport rolls 9 from each other.

Finally, in a step S3, the control device 5 accepts characteristic variables of the desired milling process. The characteristic variables of the desired milling process especially include a stock reduction 6 and a desired milling speed vW. The stock reduction 6 can alternatively be predetermined as an absolute or as a relative stock reduction.

On the basis of the characteristic variables δ, vW of the desired milling process, the control device 5 determines in a step S4 by means of a model 13 in a way known per the stand settings for the roll stand 1. The stand settings especially include a roll gap g and a peripheral speed vU of the working rolls 6 of the roll stand 1. The roll gap g is a function of the width b, the thickness d, the temperature T, the material composition Z, the desired stock reduction 6, the stand rigidity and if necessary further variables. The peripheral speed vU of the working rolls 6 is especially a function of the thickness d, the stock reduction 6, the milling speed vW, the roll gap g and if necessary further variables.

In steps S5 to S8 the control device 5 tests whether different conditions are fulfilled. Steps S5 to S8 do not all have to be present. Step S8 in particular could be omitted. At least one of steps S5 to S7 must however be present. The most important step would probably be step S5.

In step S5 the control device 5 initially tests whether the length L of the rolling stock 8 is less than a limit length L. The limit length L preferably amounts to a multiple of the distance a of the transport rolls 9 from each other, for example five to ten times. In step S6 the control device 5 tests whether the width b of the rolling stock 8 exceeds a limit width B. The limit width B preferably likewise amounts to a multiple of the distance a between the transport rollers 9. In step S7 the control device 5 tests whether the ratio of width b to length L of the rolling stock 8 lies above a threshold value S. The threshold value S as a rule which is greater than two. As a rule it is greater than three. In step S8 the control device 5 tests whether the mass m of the rolling stock 8 lies below a limit mass M.

The tests of steps S5 to S8 can principally be combined in any fashion, for example by means of a logical OR operand. In accordance with FIG. 3 they are ANDed.

If in accordance with FIG. 3 all test of steps S5 to S8 have led to a positive result, the control device 5 executes steps S9 to S12.

In step S9 the control device 5 determines a feeding speed vE in the model 13. The feeding speed vE is the speed with which a leading edge 14 of the rolling stock 8 reaches the roll gap g. If it is determined in step S9, it is greater than the peripheral speed vU of the working rolls 6 of the roll stand 1.

In step S10 the control device 5 adjusts the material guides 4 to the rolling stock 8. It thus adjusts the material guides 4 such that they do not touch the rolling stock 8. In step S11 the control device 5 triggers the roll stand 1 such that the stand settings determined in step S4 are made. In particular the control device 5 thus triggers the roll stand 1 such that the working rolls 6 form the roll gap g and that the working rolls 6 turn with the peripheral speed vU.

In step S12 the control device 5 triggers the roll train 2 arranged on the entry side such that the leading edge 14 of the rolling stock 8 feeds into the roll gap g at the feeding speed vE.

Figure 4:
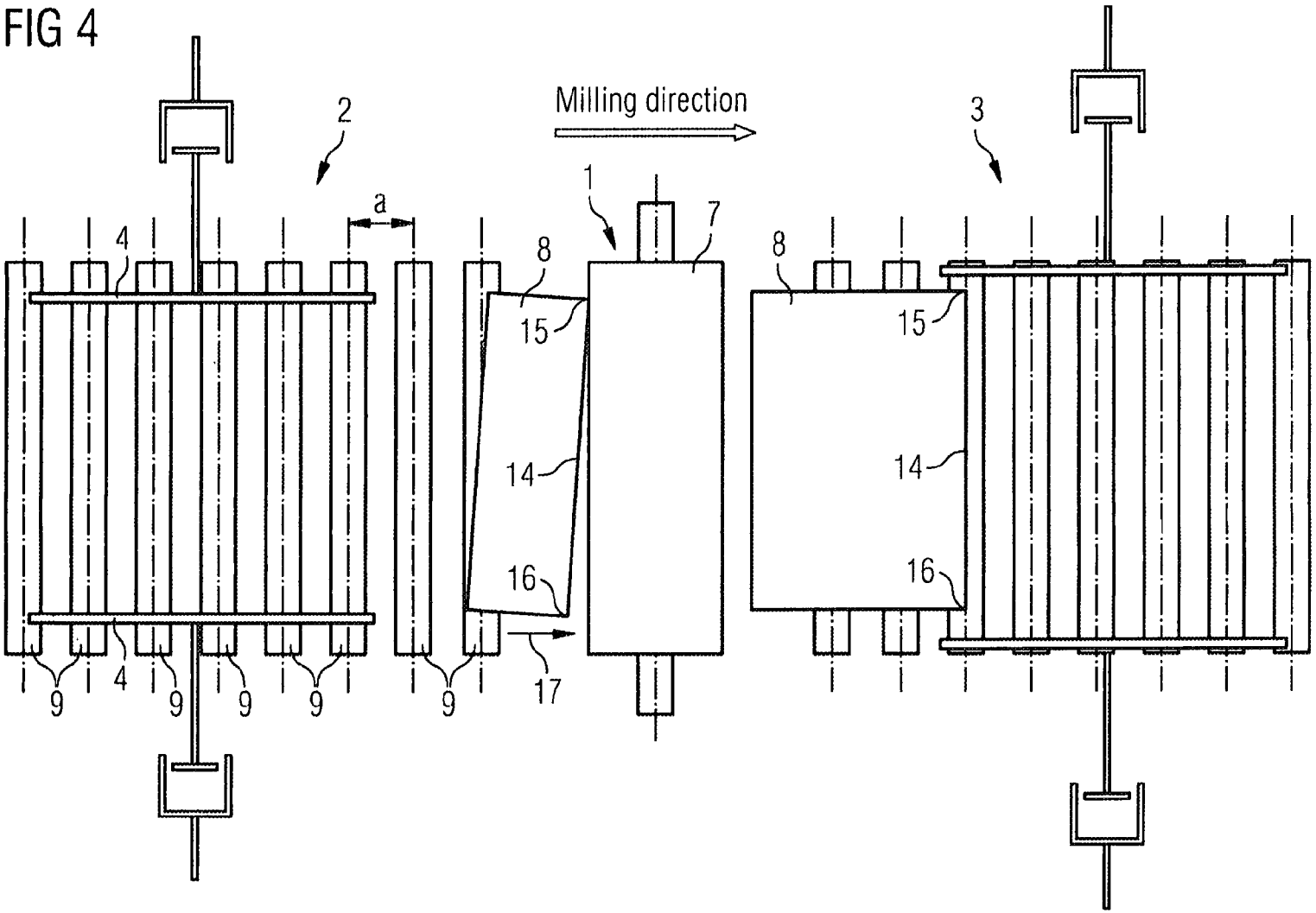
FIG. 4 a first option for reducing an angled position of the leading edge relative to the roll gap and FIG. 5 a second option for reducing an angled position of the leading edge relative to the roll gap.
Figure 5:
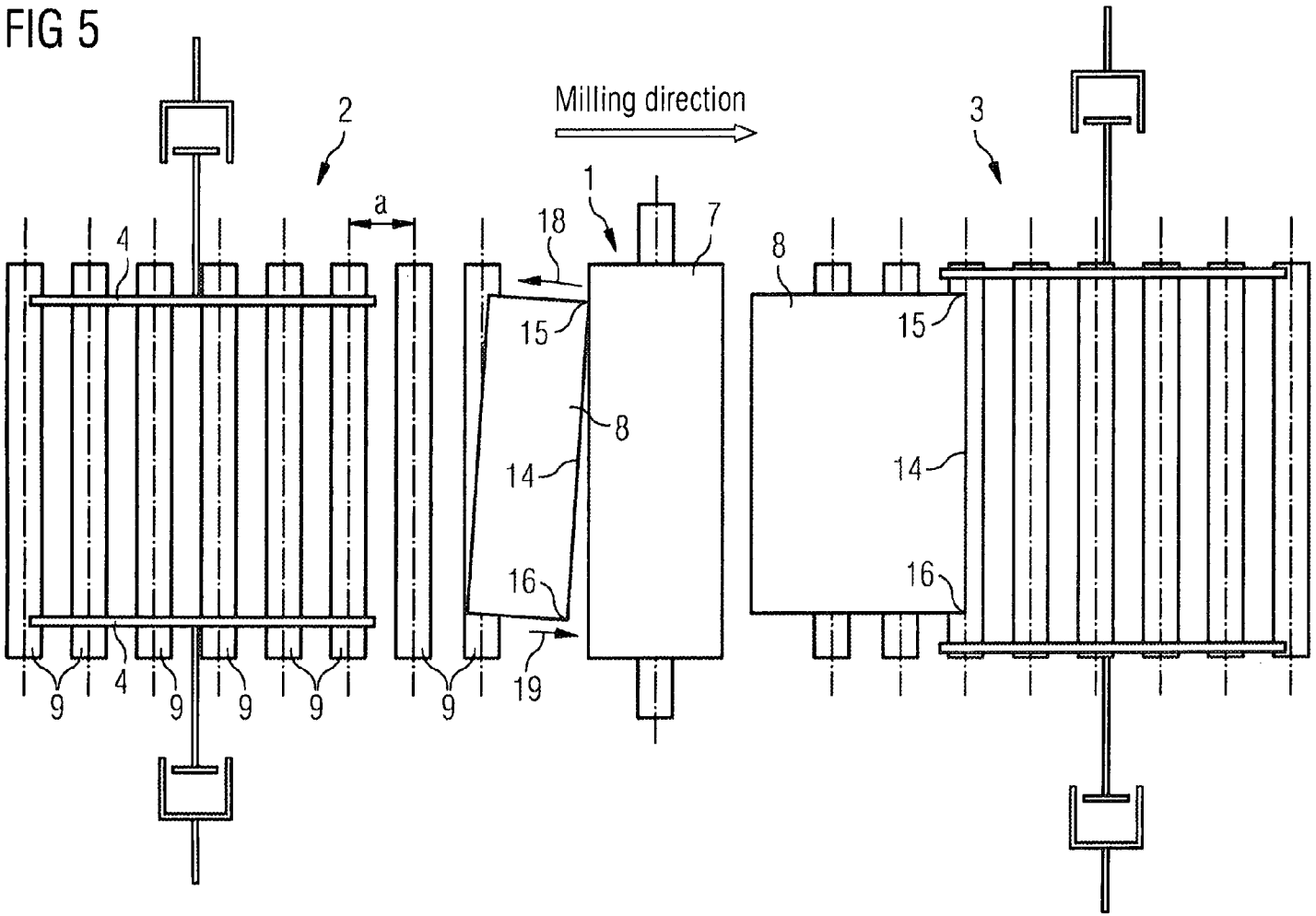

In accordance with FIG. 2 the leading edge 14 of the rolling stock 8 has two ends 15, 16. In the ideal case the leading edge 14 is aligned in parallel with roll gap g and thus also runs into the roll gap g in this position. In this case both ends 15, 16 reach the roll gap g simultaneously. In practice—see FIGS. 4 and 5—as a rule one of the ends 15, 16 of the leading edge 14, here end 15, reaches the roll gap g before the other of the ends 15, 16 of the leading edge, here the end 16. Leading edge 14 thus has an angled position relative to roll gap g. For this reason the control device 5 determines the feeding speed vE within the framework of step S9, such that because of the synchronization of the peripheral speed vU and the feeding speed vE such an angled position of the leading edge 14 relative to the roll gap g is at least reduced. The feeding speed vE is a function which can depend on the length L, the width b, the thickness d and the mass m of the rolling stock 8, the peripheral speed vU, the distance a and if necessary also on further variables. The functional relationship between the feeding speed vE can be determined on the basis of theoretical considerations and/or experimentally.

The feeding speed vE is determined as a rule by the control device 5 so that although the working rolls 6 hold the end 15 reaching the roll gap g first, because of the mass inertia of the rolling stock 8 the rolling stock 8 slides on the transport rollers 9 onto the working rolls 6. The control device 5 thus determines the peripheral speed vU and the feeding speed vE such that the strip-shaped rolling stock 8 in this case turns around the end 15 reaching the roll gap g first. This method of operation is indicated schematically in FIG. 4 by an arrow 17.

It is however also possible for the synchronization of the peripheral speed vU and the feeding speed vE to be undertaken by the control device 5 such that the strip-shaped rolling stock 8, in the event of one of the ends 15, 16 of the leading edge 14 (here end 15) reaching the roll gap g before the other of the ends 15, 16 of the leading edge 14 (here the end 16), rebounds from the roll gap g with its end 15 which reaches the roll gap first. This is shown schematically in FIG. 5 by arrows 18, 19, with arrow 18 being larger than arrow 19.

If—in accordance with FIG. 3—one of the tests of step S5 to S8 is not satisfied, the control device 5 executes steps S13 and S14 instead of steps S9 and S10.

In step S13 the control device 5—in a similar manner to step S9—determines the feeding speed vE. However it determines the feeding speed vE within the context of step S13 such that an angled position of the leading edge 14 relative to the roll gap g is not reduced because of the synchronization of peripheral speed vU and feeding speed vE. The feeding speed vE can also especially be lower than the peripheral speed vU.

It can however continue to be a function of the length L, the width b, the mass m, the thickness d, the peripheral speed vU and possibly further variables such as for example the distance a between the transport rollers 9.

In step S14 the control device 5 adjusts the material guides 4 to the rolling stock 8. It thus adjusts the material guides 4 such that they touch the strip-shaped rolling stock 8. In this case the rolling stock 8 is thus aligned by the material guides 4.

Thus an at least almost parallel alignment of the leading edge 14 relative to the roll gap g is achieved by means of the inventive method of operation, if this alignment is not able to be achieved by means of the material guides 4. The inventive method of operation, i.e. the synchronization of the peripheral speed vU and the feeding speed vE such that, because of this synchronization any angled position of the leading edge 14 relative to the roll gap g is at least reduced, works especially well in cases in which the conventional alignment by means of the material guides 4 fails. It works especially well with short, wide rolling stock 8. It thus represents an almost ideal supplement to the conventional method of operation.

The invention claimed is:

1. A method of operating a rolling mill that mills a strip-shaped rolling stock, where the rolling mill has a roll stand with working rolls, a roll train located at a feeding end of the roll stand and a control device, and the strip-shaped rolling stock has a leading edge with two ends, the method comprising:

forming a roll gap between the working rolls;

triggering the roll stand via the control device such that the working rolls of the roll stand turn with a peripheral speed;

triggering the roll train located at the feeding end of the roll stand via the control device such that the leading edge of the strip-shaped rolling stock travels at a feeding speed;

determining if an execution condition is fulfilled, wherein the execution condition is based at least in part on a characteristic variable of the strip-shaped rolling stock; and synchronizing the peripheral speed and the feeding speed if the execution condition is fulfilled so that the feeding speed is greater than the peripheral speed, via the control device such that, because of the synchronization of the peripheral speed and the feeding speed, any angled position of the leading edge relative to the roll gap is at least reduced.

2. The method as claimed in claim 1, wherein the control device synchronizes the peripheral speed and the feeding speed such that the strip-shaped rolling stock in the event of one of the ends of the leading edge reaching the roll gap before the other of the ends of the leading edge, turns around the end reaching the roll gap first.

3. The method as claimed in claim 1, wherein the control device synchronizes the peripheral speed and the feeding speed such that the strip-shaped rolling stock in the event of one of the ends of the leading edge reaching the roll gaps before the other of the ends of the leading edge, rebounds from the roll gap with the end first reaching the roll gap.

4. The method as claimed in claim 1, wherein the roll train located on the feeding side of the roll stand features material guides that are adjustable laterally to the strip-shaped rolling stock and which are adjustable to contact or not contact the strip-shaped rolling stock, and the control device sets the material guides such that the material guides do not touch the strip-shaped rolling stock.

5. The method as claimed in claim 4, wherein the control device accepts the characteristic variable of the strip-shaped rolling stock, and determines the peripheral speed and the feeding speed in a model, based on the characteristic variable.

6. The method as claimed in claim 5, wherein the control device uses the characteristic variable to test whether the execution condition is fulfilled, the control device only synchronizes the peripheral speed and the feeding speed if the execution condition is fulfilled, and the control device otherwise synchronizes the peripheral speed and the feeding speed such that any angled position of the leading edge relative to the roll gap is not reduced because of the synchronization of the peripheral speed and the feeding speed, and also adjusts the material guides to contact the strip-shaped rolling stock.

7. The method as claimed in claim 6, wherein a length of the strip-shaped rolling stock, a width of the strip-shaped rolling stock, a ratio of length and width of the strip-shaped rolling stock and/or a mass of the strip-shaped rolling stock are included in the execution condition.

8. A data storage device, comprising:

a data storage medium; and a computer machine code stored on the storage medium for execution via a control device of a rolling mill that rolls a strip-shaped rolling stock, where the rolling mill has a roll stand with working rolls, a roll train located at a feeding end of the roll stand and a control device, and the strip-shaped rolling stock has a leading edge with two ends, where the code comprises:

initiating forming a roll gap between working rolls of the rolling mill;

starting the roll stand of the rolling mill via the control device such that the working rolls of the roll stand turn with a peripheral speed;

starting the roll train located at the feeding end of the roll stand via the control device such that the leading edge of the strip-shaped rolling stock travels at a feeding speed;

determining if an execution condition is fulfilled, wherein the execution condition is based at least in part on a characteristic variable of the strip-shaped rolling stock; and synchronizing the peripheral speed and the feeding speed if the execution condition is fulfilled so that the feeding speed is greater than the peripheral speed, via the control device such that, because of the synchronization of the peripheral speed and the feeding speed, any angled position of the leading edge relative to the roll gap is reduced.

9. The data storage device as claimed in claim 8, wherein the control device synchronizes the peripheral speed and the feeding speed such that the strip-shaped rolling stock in the event of one of the ends of the leading edge reaching the roll gap before the other of the ends of the leading edge, turns around the end reaching the roll gap first.

10. The data storage device as claimed in claim 8, wherein the control device synchronizes the peripheral speed and the feeding speed such that the strip-shaped rolling stock in the event of one of the ends of the leading edge reaching the roll gaps before the other of the ends of the leading edge, rebounds from the roll gap with the end first reaching the roll gap.

11. The data storage device as claimed in claim 8, wherein the roll train located on the feeding side of the roll stand features material guides that are adjustable laterally to the strip-shaped rolling stock and which are adjustable to contact or not contact the strip-shaped rolling stock, and the control device sets the material guides such that the material guides do not touch the strip-shaped rolling stock.

12. The data storage device as claimed in claim 11, wherein the control device accepts the characteristic variable of the strip-shaped rolling stock, and determines the peripheral speed and the feeding speed in a model, based on the characteristic variable.

13. The data storage device as claimed in claim 12, wherein the control device uses the characteristic variable to test whether the execution condition is fulfilled, the control device only synchronizes the peripheral speed and the feeding speed if the execution condition is fulfilled, and the control device otherwise synchronizes the peripheral speed and the feeding speed such that any angled position of the leading edge relative to the roll gap is not reduced because of the synchronization of the peripheral speed and the feeding speed, and also adjusts the material guides to contact the strip-shaped rolling stock.

14. The data storage device as claimed in claim 13, wherein a length of the strip-shaped rolling stock, a width of the strip-shaped rolling stock, a ratio of length and width of the strip-shaped rolling stock and/or a mass of the strip-shaped rolling stock are included in the execution condition.

15. A rolling mill for milling a strip-shaped rolling stock, comprising:

a roll stand with working rolls;

a roll train located at a feeding end of the roll stand; and a control device, wherein the working rolls form a roll gap, the control device triggers the roll stand such that the working rolls of the roll stand turn with a peripheral speed, the control device triggers the roll train located on the feeding side of the roll stand such that a leading edge of the strip-shaped rolling stock travels at a feeding speed;

determining if an execution condition is fulfilled, wherein the execution condition is based at least in part on a characteristic variable of the strip-shaped rolling stock; and the control device synchronizes the peripheral speed and the feeding speed if the execution condition is fulfilled so that the feeding speed is greater than the peripheral speed such that, because of the synchronization of the peripheral speed and the feeding speed any angled position of the leading edge relative to the roll gap is at least reduced.

16. The rolling mill as claimed in claim 15, wherein the control device synchronizes the peripheral speed and the feeding speed such that the strip-shaped rolling stock in the event of one of the ends of the leading edge reaching the roll gap before the other of the ends of the leading edge, turns around the end reaching the roll gap first.

17. The rolling mill as claimed in claim 15, wherein the control device synchronizes the peripheral speed and the feeding speed such that the strip-shaped rolling stock in the event of one of the ends of the leading edge reaching the roll gaps before the other of the ends of the leading edge, rebounds from the roll gap with the end first reaching the roll gap.

18. The rolling mill as claimed in claim 15, wherein the roll train located on the feeding side of the roll stand features material guides that are adjustable laterally to the strip-shaped rolling stock and which are adjustable to contact or not contact the strip-shaped rolling stock, and the control device sets the material guides such that the material guides do not touch the strip-shaped rolling stock.

19. The rolling mill as claimed in claim 18, wherein the control device accepts the characteristic variable of the strip-shaped rolling stock, and determines the peripheral speed and the feeding speed in a model, based on the characteristic variable.

20. The rolling mill as claimed in claim 19, wherein the control device uses the characteristic variable to test whether the execution condition is fulfilled, the control device only synchronizes the peripheral speed and the feeding speed if the execution condition is fulfilled, and the control device otherwise synchronizes the peripheral speed and the feeding speed such that any angled position of the leading edge relative to the roll gap is not reduced because of the synchronization of the peripheral speed and the feeding speed, and also adjusts the material guides to contact the strip-shaped rolling stock.

* * * * *